US006857584B2

(12) United States Patent
Sebastian et al.

(10) Patent No.: US 6,857,584 B2
(45) Date of Patent: Feb. 22, 2005

(54) FUEL INJECTION VALVE

(75) Inventors: Thomas Sebastian, Stuttgart (DE); Matthias Boee, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 159 days.

(21) Appl. No.: 10/110,253

(22) PCT Filed: Aug. 3, 2001

(86) PCT No.: PCT/DE01/02961

§ 371 (c)(1),
(2), (4) Date: Aug. 27, 2002

(87) PCT Pub. No.: WO02/12712

PCT Pub. Date: Feb. 14, 2002

(65) Prior Publication Data

US 2003/0102386 A1 Jun. 5, 2003

(30) Foreign Application Priority Data

Aug. 10, 2000 (DE) ..... 100 39 077

(51) Int. Cl.[7] ..... F02M 59/00; F02M 39/00; B05B 1/30

(52) U.S. Cl. ..... 239/533.2; 239/533.3; 239/585.1; 239/585.3; 239/585.5

(58) Field of Search ..... 239/533.2, 533.3, 239/533.9, 585.1, 585.3–585.5, 88–93, 533.7, 900; 251/129.15, 129.21, 127

(56) References Cited

U.S. PATENT DOCUMENTS

| | | | | |
|---|---|---|---|---|
| 4,946,107 A | | 8/1990 | Hunt | |
| 4,984,549 A | | 1/1991 | Mesenich | |
| 5,275,341 A | * | 1/1994 | Romann et al. | 239/585.4 |
| 5,397,055 A | * | 3/1995 | Paul et al. | 239/124 |
| 5,544,816 A | * | 8/1996 | Nally et al. | 239/585.5 |
| 5,570,842 A | | 11/1996 | Kindley | |
| 5,580,001 A | * | 12/1996 | Romann et al. | 239/585.4 |
| 5,625,946 A | * | 5/1997 | Wildeson et al. | 29/888.41 |
| 6,079,642 A | | 6/2000 | Maier | |

FOREIGN PATENT DOCUMENTS

| | | |
|---|---|---|
| DE | 195 03 821 | 8/1996 |
| DE | 196 26 576 | 1/1998 |
| WO | WO 99 53189 | 10/1999 |

* cited by examiner

*Primary Examiner*—Davis Hwu
(74) *Attorney, Agent, or Firm*—Kenyon & Kenyon

(57) ABSTRACT

A fuel injector, particularly a fuel injector for fuel injection systems of internal combustion engines, has a magnetic coil, an armature acted upon in a closing direction by a resetting spring and a valve needle connected to the armature by force-locking for operating a valve-closure member, which forms a sealing seat together with a valve-seat surface. The armature has a pot-shaped axial extension, in which at least one cutout is formed.

16 Claims, 2 Drawing Sheets

FUEL INJECTION VALVE

FIELD OF THE INVENTION

The present invention relates to a fuel injector.

BACKGROUND INFORMATION

German Published Patent Application No. 196 26 576 an electromagnetically operable fuel injector describes in which, for the electromagnetic actuation, an armature cooperates with an electrically energizable magnetic coil, and the lift of the armature is transmitted to a valve-closure member via a valve needle. The valve-closure member interacts with a valve-seat surface to form a sealing seat. Several fuel channels are provided in the armature. The armature is reset by a resetting spring.

An electromagnetically operable fuel injector is also described in German Published Patent Application No. 195 03 821, in which an armature also cooperates with an electrically energizable magnetic coil. The lift of the armature is transmitted to a valve-closure member by a valve needle.

What is disadvantageous about the fuel injectors known from the above-named documents is particularly the lack of free flow space for the fuel, which is caused by the positioning of the valve needle in a hollow recess in the armature. This leads to big pressure differences between the upper and the lower sides of the armature, particularly during movement of the armature, since pressure equalization is hindered. The diameter of borings in the armature, put there to make it possible for the fuel to pass through, is limited because of the necessary armature pole surface and the low space availability.

It is also disadvantageous that the hydraulic pressure force of the fuel on the armature leads especially to longer valve opening times, which has a corresponding effect on the quantity of fuel metered in. On the other hand, due to fluctuations in the pressure difference, for example, in the case of different temperatures of the fuel injector, and viscosity differences resulting from this, variations in the switching time of the fuel injector are caused, which, in addition to the increased length of the switching times, lead to metering in irregular quantities of fuel.

SUMMARY OF THE INVENTION

By contrast, the fuel injector according to the present invention has the advantage that fuel can flow in an unhindered way through a large armature boring as well as through the openings arranged in a pot-shaped extension of the armature. Ideally, the armature boring should have the same diameter as an inner longitudinal recess of the internal pole of the magnetic coil. Thereby, the pressure difference between the armature upper side and lower side can be reduced to any low value desired. In addition, because of the bigger armature boring, the effective armature surface can be made smaller, and thus the remaining pressure force acting on the armature can be reduced. This leads to shorter valve opening times and to a reduction in the variation of switching times because of fluctuations in the pressure difference.

The pot-shaped extension of the armature can be designed in one piece with it, or it can be made as a separate part.

The extension preferably has at least two openings, which aids the uniform flow through the extension. However, it is also possible to have several or only one opening. Accordingly, the openings are separated from one another by an equal number of circular segments of the hollow cylindrically designed extension.

Of special advantage is the connection of the measures according to the present invention to the so-called prestroke principle, which also makes possible abbreviated opening times.

Advantageously, the component parts corresponding to the adaptation of this principle are all arranged in the downstream direction after the armature, whereby the flow through the armature is not impaired.

Particularly advantageous is the use of a hollow cylindrical valve needle, which is axially movable in the extension of the armature, and has fuel flowing through it.

DETAILED DESCRIPTION

Figure 1A:
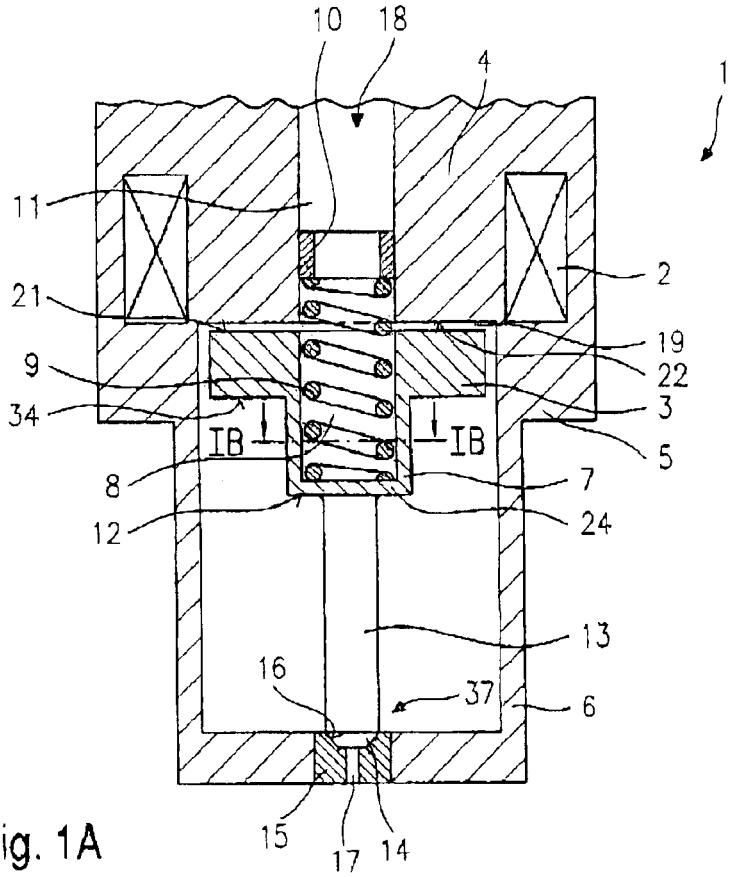
FIG. 1A shows a schematic section through a first exemplary embodiment of a fuel injector according to the present invention.
Figure 1B:
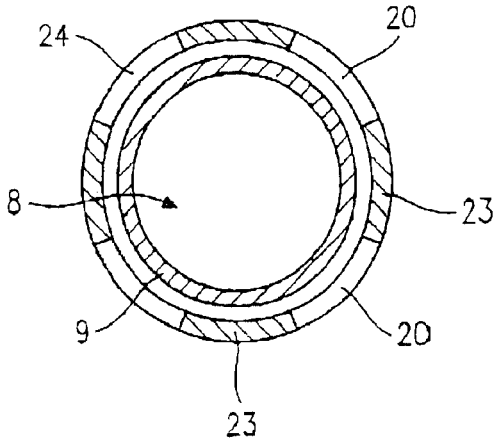
FIG. 1B shows a section along the line IB—IB in FIG. 1.

FIGS. 1A and 1B show a longitudinal section through a first exemplary embodiment of a fuel injector 1 according to the present invention, as a segment of a very much schematic sectional representation.

Fuel injector 1 has a magnetic coil 2 which acts together with an armature 3. Magnetic coil 2 acts together with an internal pole 4 and an external pole. External pole 5 continues on the downstream side in a valve housing 6.

Armature 3 has an extension 7 which is formed as a hollow cylinder and is positioned at the downstream side 34 of armature 3. Extension 7 has a bottom portion 24, which closes off extension 7 on the downstream side. In an inner recess 8, which is developed in armature 3 and extension 7, there is a resetting spring 9. Resetting spring 9 is prestressed by adjusting sleeve 10 pushed into internal pole 4 in a hollow recess 11 of internal pole 4.

A valve needle 13 is supported at a downstream end 12 of the extension 7. Valve needle 13 is preferably welded to the bottom portion 24 of extension 7. At a downstream end 37, valve needle 13 has valve-closure member 14, which collaborates with a valve-seat surface 16 formed in a valve-seat element 15 to form a sealing seat.

Fuel injector 1 shown in FIG. 1A is a fuel injector 1 opening toward the inside. In valve seat element 15 a spray-discharge opening 17 is formed. Fuel is let in via a central fuel supply 18, flows through hollow section 11 of internal pole 4 as well as through recess 8 of extension 7 and leaves extension 7 through openings 20 marked more clearly in FIG. 1B. Thereafter, the fuel flows through valve housing 6 to the sealing seat.

When fuel injector 1 is at rest, valve-closure member 14 is held in sealing contact to valve-seat surface 16 by the stress of resetting spring 9. Fuel injector 1 is thus closed. If an energizing current is supplied to magnetic coil 2, armature 3 is drawn, counter to the force of the resetting spring 9, in the direction of internal pole 4, after sufficient build-up of the magnetic field. After passing through an armature lift predefined by the size of a working gap 19, armature 3 strikes with its inlet-side armature endface 21 against an armature stop 22 developed in internal pole 4. Fuel flows from central fuel supply 18 through hollow recesses 11 and 8, as well as openings 20 in the direction of the sealing seat.

If the current energizing magnetic coil 2 is switched off, after sufficient fall-off in the magnetic field, armature 3 falls away from internal pole 4 because of the force of resetting spring 9, which causes valve needle 13 to move in the downstream direction, valve-closure member 14 to move onto valve-seat surface 16, and fuel injector 1 to be closed.

In an extracted schematic sectional illustration, FIG. 1B shows a section through extension 7, along line IB—IB of FIG. 1A.

The basic shape of extension 7 is hollow cylindrical and it is made up of several segments 23, preferably at least two, between which, in the circumferential direction, there is a corresponding number of openings 20. Segments 23 form a casing portion of extension 7, and are preferably made as one piece with the bottom portion 24 of extension 7. Resetting spring 9 is supported on bottom portion 24. On the side opposite bottom portion 24 from resetting spring 9, valve needle 13 is supported, as shown in detail in FIG. 1A. The fuel, which flows in centrally, flows through inner recess 8 of extension 7 and out of extension 7 through openings 20. By the size of inner recess 8 and openings 20 between segments 23 it is ensured that the fuel can flow through fuel injector 1 without being significantly dammed up at armature 3.

Fuel injector 1 according to the present invention is advantageously operated when the so-called prestroke principle is used. In this connection, armature 3 is pre-accelerated and runs through a partial lift, during which valve needle 13 is not yet carried along. Only when a first armature stop is reached is the valve needle carried along via suitable devices and against the force of a second resetting spring.

If, in addition, fuel injector 1 is constructed in such a way that the additional component parts, making possible the partial lift, are arranged in the downstream direction after armature 3, the magnetic circuit remains uninfluenced by the partial lift. That is why, among other things, the diameter of internal pole 4 can be selected to be smaller, whereby the effective pole surface, and thus the effectively working magnetic force is increased.

Figure 2:
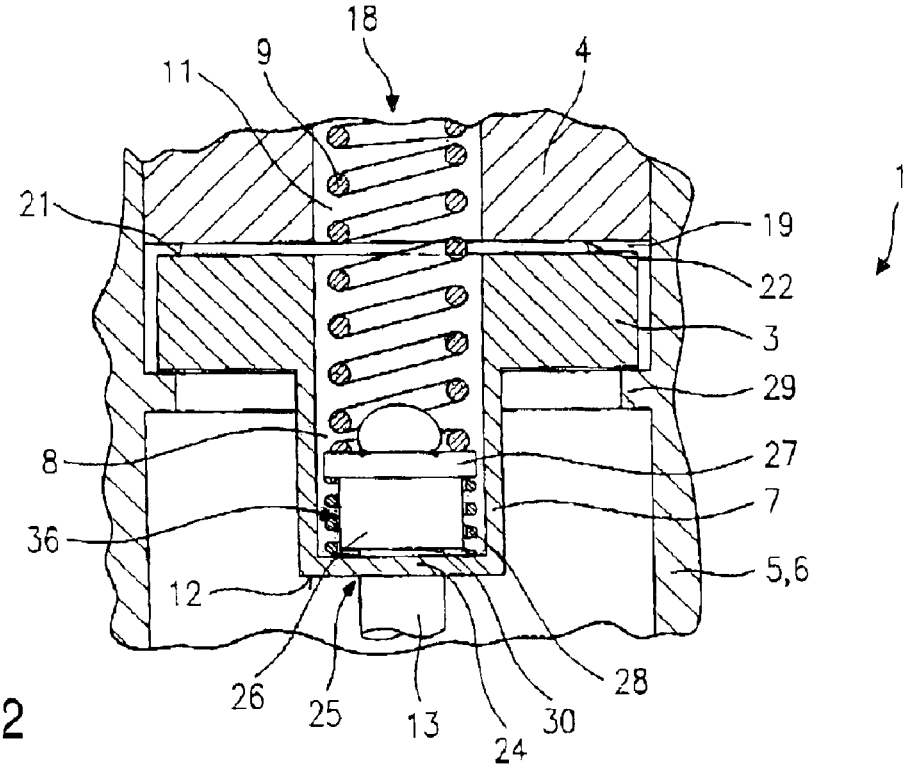
FIG. 2 shows a schematic section through a second exemplary embodiment of a fuel injector according to the present invention.
Figure 3:
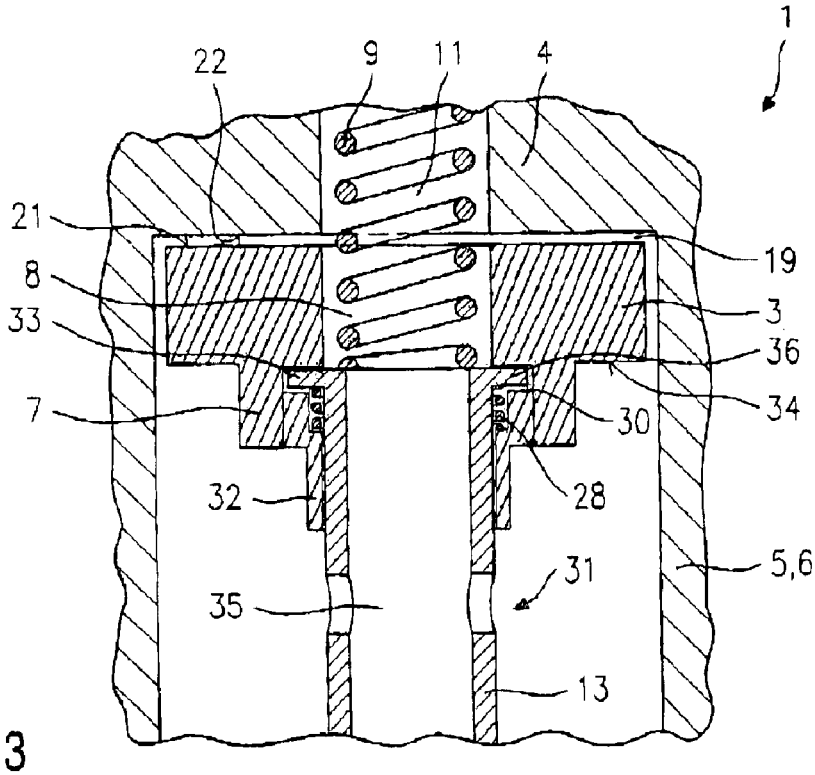
FIG. 3 shows a schematic section through a third exemplary embodiment of a fuel injector according to the present invention.

Two exemplary embodiments of fuel injector 1 according to the present invention, in conjunction with the prestroke principle, are described in more detail in the light of FIGS. 2 and 3. In FIGS. 2 and 3, corresponding component parts are giving corresponding reference numerals to those in FIG. 1A.

In a partial sectional illustration, slightly enlarged over FIG. 1A, FIG. 2 shows a second exemplary embodiment of fuel injector 1 according to the present invention.

In order to be able to apply the prestroke principle, extension 7 of armature 3 has an opening 25 in bottom portion 24 which is penetrated by valve needle 13. At its fuel inlet end 36, valve needle 13 has a flange 26 having a projecting collar 27. Valve needle is preferably welded to flange 26, but can also be made as one piece with it. First resetting spring 9 is supported on collar 27 of flange 26. Between collar 27 and bottom portion 24, a second resetting spring 28 is clamped in. With regard to this, the spring constant of second resetting spring 28 is substantially smaller than the spring constant of first resetting spring 9, in order to make possible the movement of armature 3 without valve needle 13.

In the state of rest of fuel injector 1, first resetting spring 9 presses valve needle 13 onto the sealing seat via collar 27 of flange 26. During this time, armature 3 rests upon an armature seat 29 which is formed ring-shaped in valve housing 6. If a current is made to flow through magnetic coil 2, not shown in detail in FIG. 2, armature 3 moves in the direction of internal pole 4. At this point in time, armature 3 has to move only against the force of second resetting spring 28, since the spring constant of second resetting spring 28 is so small that armature 3 is not substantially impeded in its motion, valve needle 13, however, still remaining at rest. After running through a prestroke corresponding to the height of prestroke gap 30 between bottom portion 24 of extension 7 and flange 26 of valve needle 13, bottom portion 24 of extension 7 strikes flange 26, and armature 3, via flange 26, takes valve needle 13 along with it in the lift direction in opposition to the force of first resetting spring 9, which opens fuel injector 1.

As soon as working gap 19 is closed, armature endface 21 on the fuel inlet side of armature 3 strikes armature stop 22 of internal pole 4. As long as current is running through magnetic coil 2, fuel injector 1 remains in the open position. If the coil current is switched off, armature 3, because of the force of first resetting spring 9, falls away from internal pole 4, together with flange 26 and valve needle 13 connected to flange 26 by force-locking. The closing motion takes place in one move over the total lift, whereby fuel injector 1 may be rapidly closed.

FIG. 3 shows in an extract the schematic section illustration of a third exemplary embodiment of fuel injector 1 according to the present invention in conjunction with the prestroke principle.

In contrast to the exemplary embodiment shown in FIG. 2, valve needle 13 in this present exemplary embodiment is designed as a hollow cylinder, and thereby it assumes the function of extension 7 which is now designed in rudimentary fashion. Valve needle 13 has transversely running discharge ports 31. Extension 7 of armature 3 in the present exemplary embodiment is formed without bottom portion 24, but is instead welded to a sleeve 32 which is penetrated by valve needle 13.

At its fuel inlet end, valve needle 13 has a collar 33 which is pressed against the downstream side of armature endface 34 by second resetting spring 28, which is clamped in between sleeve 32 and collar 33. First resetting spring 9 is set in recess 8 of armature 3, and it is supported on fuel inlet side end 36 of valve needle 13. The sum of the cross-sectional areas of the transversely running discharge ports 31 of valve needle 13 should be greater than, or at least equal to the cross-sectional area of recess 8 of armature 3.

If a current is run through magnetic coil 2, just the same as in the exemplary embodiment in FIG. 2, armature 3 goes through a prestroke lift corresponding to the height of prestroke lift gap 30 between sleeve 32 and collar 33 of valve needle 13. As soon as sleeve 32 strikes collar 33, armature 3 moves valve needle 13 along with it counter to the force of first resetting spring 9. After running through the prestroke lift and the closing of working gap 19 between fuel inlet side armature endface 21 and armature stop 22 of internal pole 4, armature 3 strikes internal pole 4. As long as the magnetic coil has current running through it, fuel injector 1 remains in the open position.

If the current energizing magnetic coil 2 is switched off, after a sufficient reduction of the magnetic field, armature 3 falls away from internal pole 4 because of the force of first resetting spring 9, and the fuel injector is closed.

An inner recess 35 of valve needle 13 is given a diameter slightly smaller than recess 11 of internal pole 4 and recess 8 of armature 3. That is why a slight ram pressure can form on collar 33, which supports the functioning of fuel injector 1 by making a minor contribution to the closing force.

The present invention is not limited to the exemplary embodiments shown, and can also be used, for example, for fuel injectors 1 opening outwards.

What is claimed is:

1. A fuel injector, comprising:

a magnetic coil;

a resetting spring;

an armature acted upon in a closing direction by the resetting spring, the armature including a pot-shaped axial extension in which at least one opening is formed;

a valve closure member;

a valve seat surface;

a valve needle connected to the armature in a force-locking manner and for operating the valve-closure member, the valve needle forming a sealing seat together with the valve-seat surface, wherein:

the pot-shaped axial extension includes a bottom portion and at least two segments forming a casing portion, and the pot-shaped axial extension is connected to the armature in a force-locking manner.

2. The fuel injector according to claim 1, wherein:

the fuel injector is for a fuel injection system of an internal combustion engine.

3. The fuel injector according to claim 1, wherein:

the armature includes an inner recess in which the resetting spring is installed.

4. The fuel injector according to claim 1, further comprising:

an adjusting sleeve, wherein:

the resetting spring is clamped in between the adjusting sleeve and the bottom portion.

5. The fuel injector according to claim 1, wherein:

the bottom portion includes a cutout that is penetrated by the valve needle.

6. The fuel injector according to claim 1, further comprising:

a flange, wherein:

the valve needle is connected to the flange in a force-locking manner at a fuel inlet end.

7. The fuel injector according to claim 6, wherein:

the flange includes a collar on which the resetting spring is supported.

8. The fuel injector according to claim 7, further comprising:

an armature seat on which the armature is supported during a state of rest of the fuel injector.

9. The fuel injector according to claim 7, further comprising:

a second resetting spring clamped in between the collar of the flange and a bottom portion of the pot-shaped axial extension.

10. The fuel injector according to claim 1, further comprising:

an electromagnetic circuit including an internal pole, wherein:

the armature cooperates with the internal pole, each one of the internal pole and the armature includes an inner recess, and a diameter of the internal recess of the armature corresponds to a diameter of the internal recess of the internal pole.

11. A fuel injector comprising:

a magnetic coil;

a resetting spring;

an armature acted upon in a closing direction by the resetting spring, the armature including a pot-shaped axial extension in which at least one opening is formed;

a valve closure member;

a valve seat surface;

a valve needle connected to the armature in a force-locking manner and for operating the valve-closure member, the valve needle forming a sealing seat together with the valve-seat surface, wherein:

the pot-shaped axial extension includes a bottom portion and at least two segments forming a casing portion, and the valve needle is connected to the pot-shaped axial extension in a force-locking manner.

12. A fuel injector, comprising:

a magnetic coil;

a resetting spring;

an armature acted upon in a closing direction by the resetting spring, the armature including a pot-shaped axial extension in which at least one opening is formed;

a valve closure member;

a valve seat surface;

a valve needle connected to the armature in a force-locking manner and for operating the valve-closure member, the valve needle forming a sealing seat together with the valve-seat surface; and a sleeve to which the pot-shaped axial extension is connected and in which the valve needle is disposed in a manner allowing the valve needle to move.

13. The fuel injector according to claim 12, wherein:

a fuel inlet end of the valve needle includes a collar positioned between a downstream armature endface and the sleeve.

14. The fuel injector according to claim 13, further comprising:

a second resetting spring arranged between the collar and the sleeve.

15. The fuel injector according to claim 12, wherein:

the valve needle includes a hollow cylinder provided with at least two discharge ports.

16. The fuel injector according to claim 15, wherein:

a sum of cross-sectional areas of the at least two discharge ports is at least equal to a cross-sectional area of a recess of the armature.

* * * * *